United States Patent [19]

Kemp, Jr.

[11] Patent Number: 4,645,236

[45] Date of Patent: Feb. 24, 1987

[54] BOOK HOLDER

[76] Inventor: Louis F. Kemp, Jr., 5334 S. 74 E. Ave., Tulsa, Okla. 74145

[21] Appl. No.: 804,909

[22] Filed: Dec. 5, 1985

[51] Int. Cl.[4] ..... B42D 9/00; A44B 21/00; B41J 11/00

[52] U.S. Cl. ..... 281/42; 24/336; 40/352

[58] Field of Search ..... 281/42; 24/67 R, 336, 24/331; 211/96; 40/352, 356, 358; D19/34; 248/441, 443

[56] References Cited

U.S. PATENT DOCUMENTS 1,784,237 12/1930 Kaiser ..... 281/42
2,606,042 8/1952 Freber ..... 281/42
2,692,780 10/1954 Billings ..... 281/42
3,701,332 10/1972 Brooks ..... 281/42

FOREIGN PATENT DOCUMENTS 59-95324 6/1984 Japan .

*Primary Examiner*—Paul A. Bell
*Assistant Examiner*—Paul M. Heyrana, Sr.

[57] ABSTRACT

A book page holder is made from a thin flat single piece of material such as plexiglass. It has an elongated rectangularly shaped back member with a first pair of fingers on one end and the second pair of fingers on the other extended in the same direction as the first pair. There is a slit between the fingers of each pair and it is through these slits that pages of an open book are placed.

7 Claims, 2 Drawing Figures

BOOK HOLDER

BACKGROUND OF THE INVENTION

1. Field of the Invention

This invention relates to a device for holding open a book so as to free a reader's hand.

2. Description of the Background Art

If one attempts to do nothing but read a book then one can hold that book open so that the proper pages will be before that person. However, many times a person will wish to read a book or at least one or two pages thereof while doing another activity, such as making notes from that page, doing other physical activity such as eating, etc.. Various devices of book page holders have been conceived for holding books open to selected pages. Generally, the book holders are large, three dimensional and made of more than one part. For example, a device disclosed in U.S. Pat. No. 4,474,383, C. T. Kis, Oct. 2, 1984, consists of two pieces with a loop in each half rendering the device three dimensional. Similarly, the device disclosed in U.S. Pat. No. 4,335,903, Collins et al, June 22, 1982, although not generally integrally formed of a body, head and tail portions has a complex three dimensional geometry. One single piece device is disclosed in U.S. Pat. No. 2,606,402 A. Freber, Aug. 5, 1952, but it is not flat. Other prior art devices have two or more parts, are three dimensional, are mechanically complicated involving pieces that move relative to each other. These include U.S. Pat. Nos. 3,336,495; 563,381; 700,453; 783,906; 3,513,806; and 3,661,405.

SUMMARY OF THE INVENTION

My book holder is a single flat piece of material comprising an elongated shaped rectangular back member from which a pair of fingers extend at each end in the same direction forming a slit between the fingers of each pair. A book is opened and a first group of pages on one side of the open book are inserted into the slits between one pair of fingers and a second group of pages on the other side of the open book are inserted into the slit at the opposite end of the book holder. The back member is stiff enough to stop the book from closing. My book page holder does not require any projection along the back of the book. When one wishes to turn the page one merely slips that page out of one of the slits and puts it in the slit on the other end of the book holder.

DESCRIPTION OF THE PREFERRED EMBODIMENT

Figure 1:
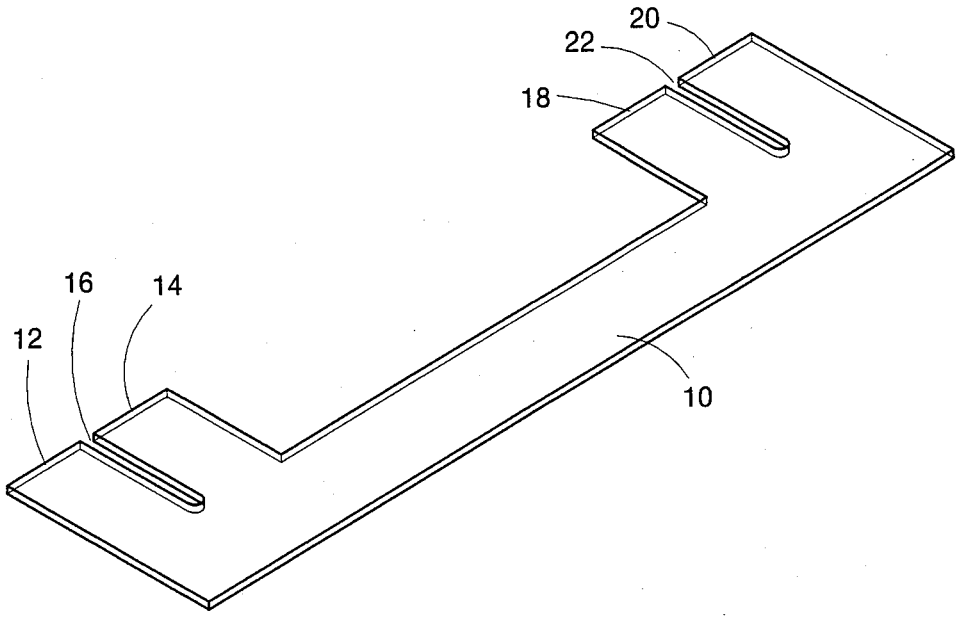
FIG. 1 is an oblique view of the book page holder.

Attention is first directed to FIG. 1 which shows the design of my book page holder. Shown thereon is a single thin essentially flat piece of material with a back member 10 from which a first pair of fingers 12 and 14 extend from one end and a secdond pair of fingers 18 and 20 extend from the other end in the same direction as the fingers 12 and 14. A slit 16 is between fingers 12 and 14 and slit 22 is between fingers 18 and 20. It is preferred that the material be transparent in the event parts of the holders might cover printed material. The long back member 10 should be rigid enough to resist any inclination of a book to close on itself.

Figure 2:
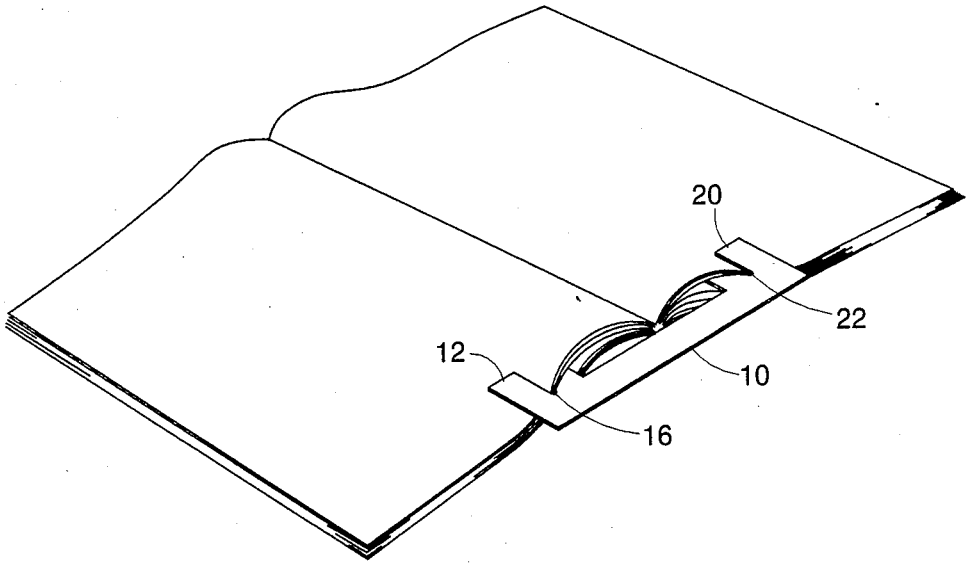
FIG. 2 is a view of the operation of the book page holder on a book.

Attention is now directed to FIG. 2 which shows a book holder in operation. The book is first opened to the desired pages and a first group of pages on the left hand side, when looking at the drawing, is inserted through slit 16. Similarly, a second group of sheets is inserted through slit 22. The number of pages in each group of pages should be sufficient so that they remain in the slits and develop sufficient friction between the pages and the slit to prevent the pages from slipping therethrough. The rigidity of the back member 10 is sufficient to keep the book from closing. One can then turn a page by slipping it out of slit 16 into 22. By removing the sheets from slits 16 and 22 the holder can serve as a bookmark when the book is closed.

I have made a prototype of the aforesaid book holder out of plexiglass 2 mm thick and find it operates as described above. The back member of this prototype is 18 cm long, the fingers are 25 mm long, 15 mm wide. The slits in this prototype are 3 mm wide and 25 mm in length.

While this invention has been described with a certain degree of particularly, it is manifest that many changes may be made in the details of construction without departing from the spirit or scope of the disclosure. The invention is not limited to the embodiment set forth herein for the purpose of exemplification, but is limited only by the scope of the attached claim or claims, including the full range of equivalent to which each element thereof is entitled.

What I claim:

1. A page holder comprising:

a thin flat single piece of material having (a) an elongated back member;

(b) a first pair of fingers on one end of said back member, there being a page receiving slit between said two fingers;

(c) a second pair of fingers spaced from said first pair on the other end of said elongated back member with a page receiving slit therebetween;

there being no protrusions from said elongated member between the pair of fingers extending beyond any of said fingers.

2. A book holder as defined in claim 1 in which the material is transparent and relatively rigid.

3. A book holder as defined in claim 2 in which the width of the slits is between 1 mm and 10 mm.

4. A book holder as defined in claim 3 in which the width of each slit is 3 mm.

5. A book holder as defined in claim 4 in which the length of the slit is 25 mm.

6. A book holder as defined in claim 5 in which the length of the back member is 18 cm.

7. A book holder as defined in claim 1 in which the back member is rectangularly shaped.

* * * * *